US006564850B1

(12) United States Patent
Chen

(10) Patent No.: US 6,564,850 B1
(45) Date of Patent: May 20, 2003

(54) SLIDING DOOR ASSEMBLY HAVING INTEGRAL DOOR PANELS

(76) Inventor: Chang Than Chen, 12F, No. 426, Ming Chuan 2nd Road, Chien Chen Chu, Kaohsiung (TW), 806

( * ) Notice: Subject to any disclaimer, the term of this patent is extended or adjusted under 35 U.S.C. 154(b) by 0 days.

(21) Appl. No.: 10/134,854

(22) Filed: Apr. 30, 2002

(51) Int. Cl.[7] ..... E06B 3/48

(52) U.S. Cl. ..... 160/231.1; 160/231.2; 160/351; 49/505

(58) Field of Search ..... 160/231.1, 231.2, 160/235, 351, 199, 201, 203, 205, 213; 49/505; 16/235, 239

(56) References Cited

U.S. PATENT DOCUMENTS

| | | | | | |
|---|---|---|---|---|---|
| 3,132,432 | A | * | 5/1964 | Yee | 160/231.1 X |
| 3,422,878 | A | | 1/1969 | Galietti | |
| 4,027,714 | A | * | 6/1977 | Dixon et al. | 160/84 R |
| 4,158,338 | A | * | 6/1979 | Dippold et al. | 109/79 |
| 4,178,859 | A | * | 12/1979 | Seiz et al. | 109/27 |
| 4,566,211 | A | | 1/1986 | Gustafson et al. | 40/605 |
| 5,133,108 | A | * | 7/1992 | Esnault | 16/225 |
| 5,148,850 | A | * | 9/1992 | Urbanick | 160/231.1 |
| 5,486,391 | A | * | 1/1996 | Tyner | 160/231.1 X |
| 5,613,541 | A | * | 3/1997 | Bradbury | 160/231.2 |
| 6,182,738 | B1 | | 2/2001 | Chen | 160/199 |
| 6,330,902 | B1 | | 12/2001 | Chen | 160/231.2 |
| 2001/0053813 | A1 | * | 12/2001 | Konno et al. | 524/521 |

FOREIGN PATENT DOCUMENTS

| | | | | |
|---|---|---|---|---|
| EP | 829588 | A2 * | 9/1997 | 160/231.1 X |

* cited by examiner

*Primary Examiner*—Bruce A. Lev
(74) *Attorney, Agent, or Firm*—Charles E. Baxley

(57) ABSTRACT

A sliding door includes two or more door panels, and one or more resilient couplings having the side stops slidably engaged in the side channels of the door panels for resiliently coupling the door panels together and for allowing the door panels to be adjusted relative to each other. The door panels each includes less than 78% by weight of a foamable material, and more than 20% by weight of wood chips or particles mixed within the foamable material, and less than 2% by weight of a vulcanizing agent, for allowing the door panels to be adjusted to different weights.

1 Claim, 4 Drawing Sheets

SLIDING DOOR ASSEMBLY HAVING INTEGRAL DOOR PANELS

BACKGROUND OF THE INVENTION

1. Field of the Invention

The present invention relates to a sliding or foldable door assembly, and more particularly to a sliding door assembly including a number of integral door panels coupled together with resilient couplings.

2. Description of the Prior Art

Typical sliding door assemblies comprise a number of door panels coupled together with pivot joints, for allowing the door panels to be folded relative to each other. U.S. Pat. No. 3,422,878 to Galietti, and U.S. Pat. No. 4,566,211 to Gustafson et al. disclose two of the typical sliding door or foldable door assemblies each having a number of door panels pivotally coupled together with flexible or resilient coupling members. The door panels each includes a number of elements or members that are required to be assembled together.

U.S. Pat. No. 6,182,738 to Chen discloses one of the other typical sliding door or foldable door assemblies and includes a number of door panels pivotally coupled together with resilient or flexible couplings. The door panels include a thin layer of plastic or wood materials that have a light weight such that the door panels may not be stably operated.

U.S. Pat. No. 6,330,902 to Chen discloses the other typical sliding door or foldable door assemblies and includes a number of door panels pivotally coupled together with resilient or flexible couplings. The door panels include a panel body made of one material, and a resilient coupling coupled to or extended from or secured to the panel body and made of the other material that is different from that of the panel body such that the door panels may not be easily made or manufactured. A number of manufacturing processes are required for making or forming the panel bodies and the resilient couplings of different materials together.

The typical door panels for the conventional sliding door assemblies are normally made of plastic or foamable materials that include a light weight, such that the door panels of light weights may not be stably operated. The other typical door panels for the conventional sliding door assemblies are made of wood or metal materials that include a heavy weight, such that the door panels of heavy weights also may not be stably operated. In addition, the materials for making or manufacturing the typical door panels for the conventional sliding door assemblies are raw materials and are not made of recycle or waste materials. Furthermore, the weights of the door panels may not be adjusted.

The present invention has arisen to mitigate and/or obviate the afore-described disadvantages of the conventional sliding door assemblies.

SUMMARY OF THE INVENTION

The primary objective of the present invention is to provide a sliding door assembly including a number of door panels coupled together with resilient couplings and manufactured or formed with a material that may be mixed with the spongy or foamable materials for suitably adjusting or determining the weight of the door panels.

In accordance with one aspect of the invention, there is provided a sliding door assembly comprising a first door panel and a second door panel each including two sides, and each including a groove and a channel formed in each of the sides thereof respectively and communicating with each other, the groove including a width greater than that of the channel of the door panels, the door panels each including at least one second longitudinal groove formed therein for weight reducing purposes, and at least one resilient coupling including two sides slidably engaged in the channels of the door panels, and including two stops provided on the sides thereof and slidably received in the grooves of the door panels for resiliently coupling the door panels together. The door panels each includes less than 78% by weight of a foamable material, and more than 20% by weight of wood chips or particles mixed within the foamable material, and less than 2% by weight of a vulcanizing agent.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
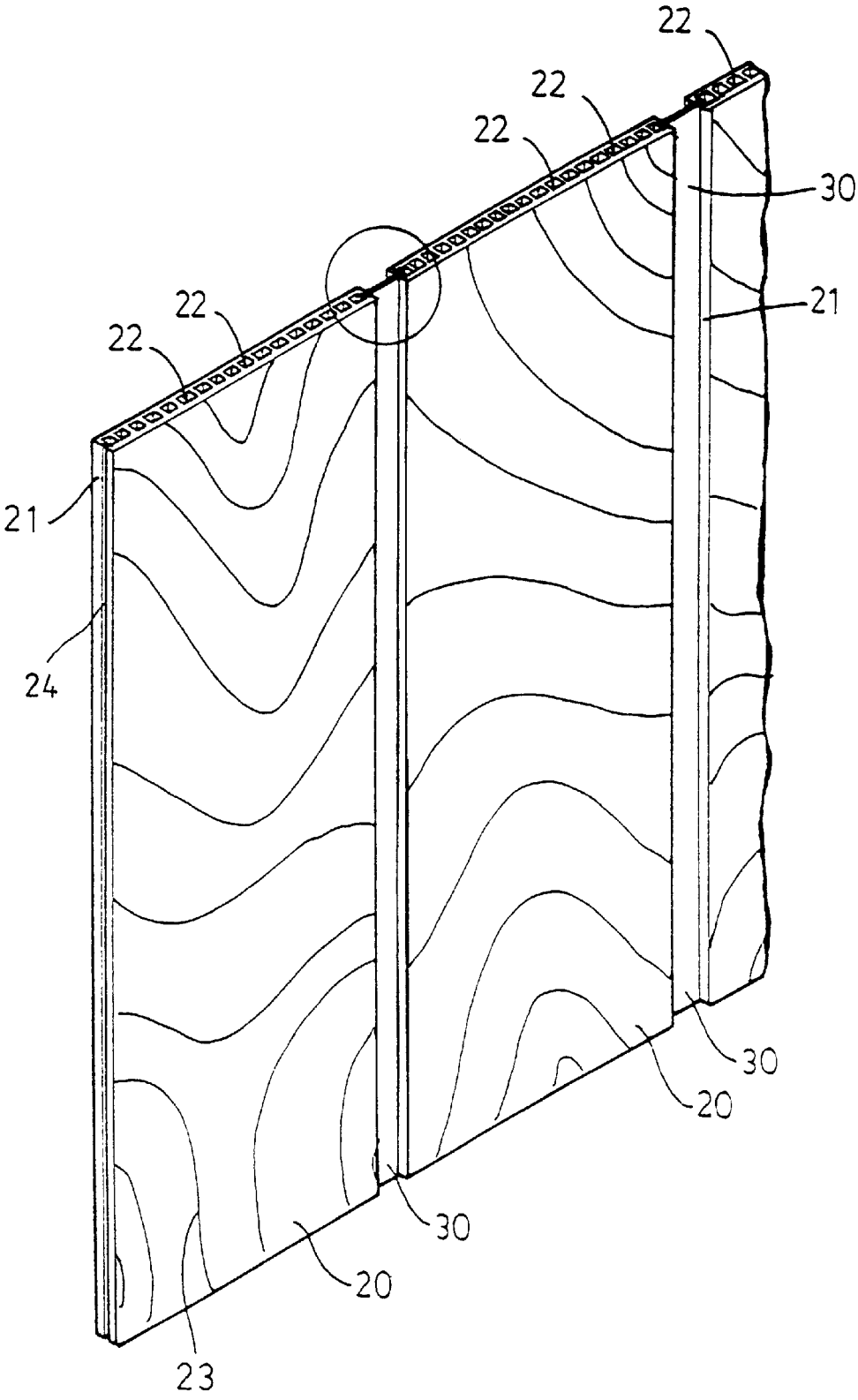
FIG. 1 is a partial perspective view of a sliding door assembly in accordance with the present invention.
Figure 2:
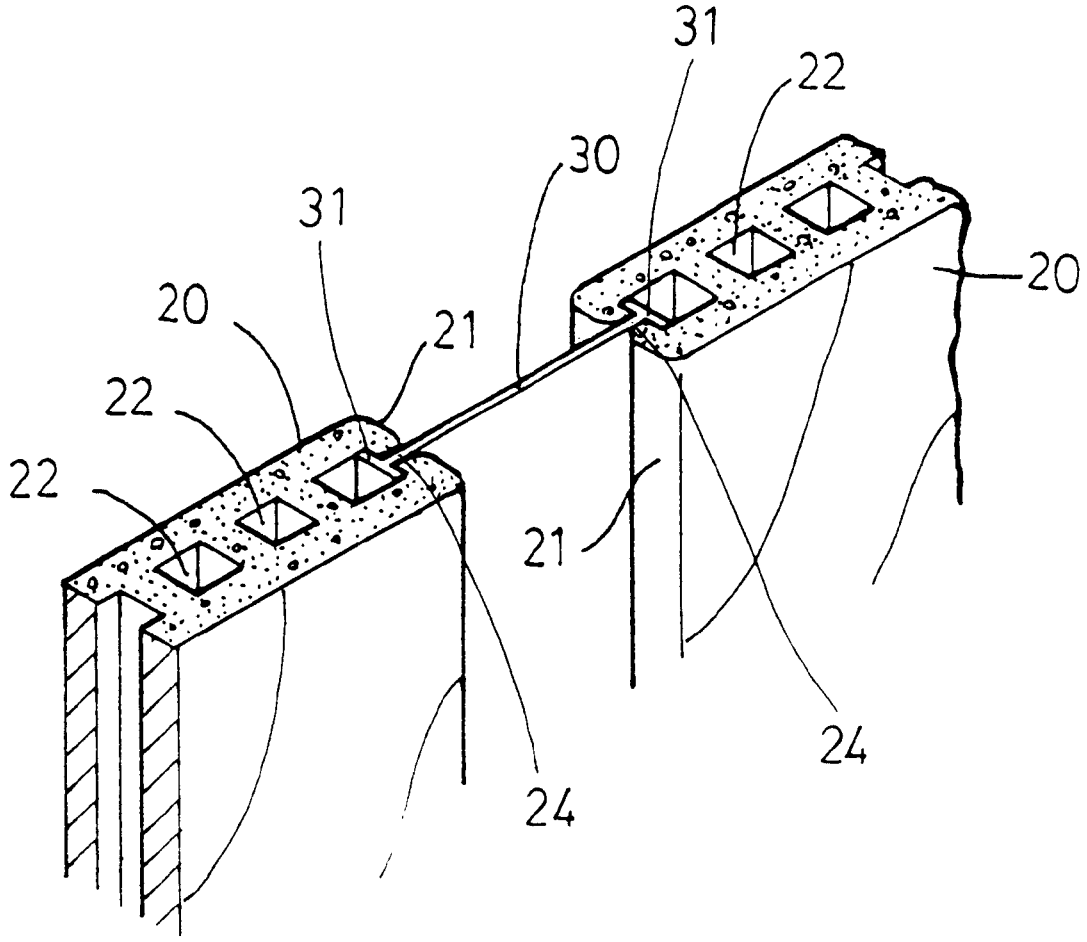
FIG. 2 is an enlarged partial perspective view of the sliding door assembly.
Figure 3:
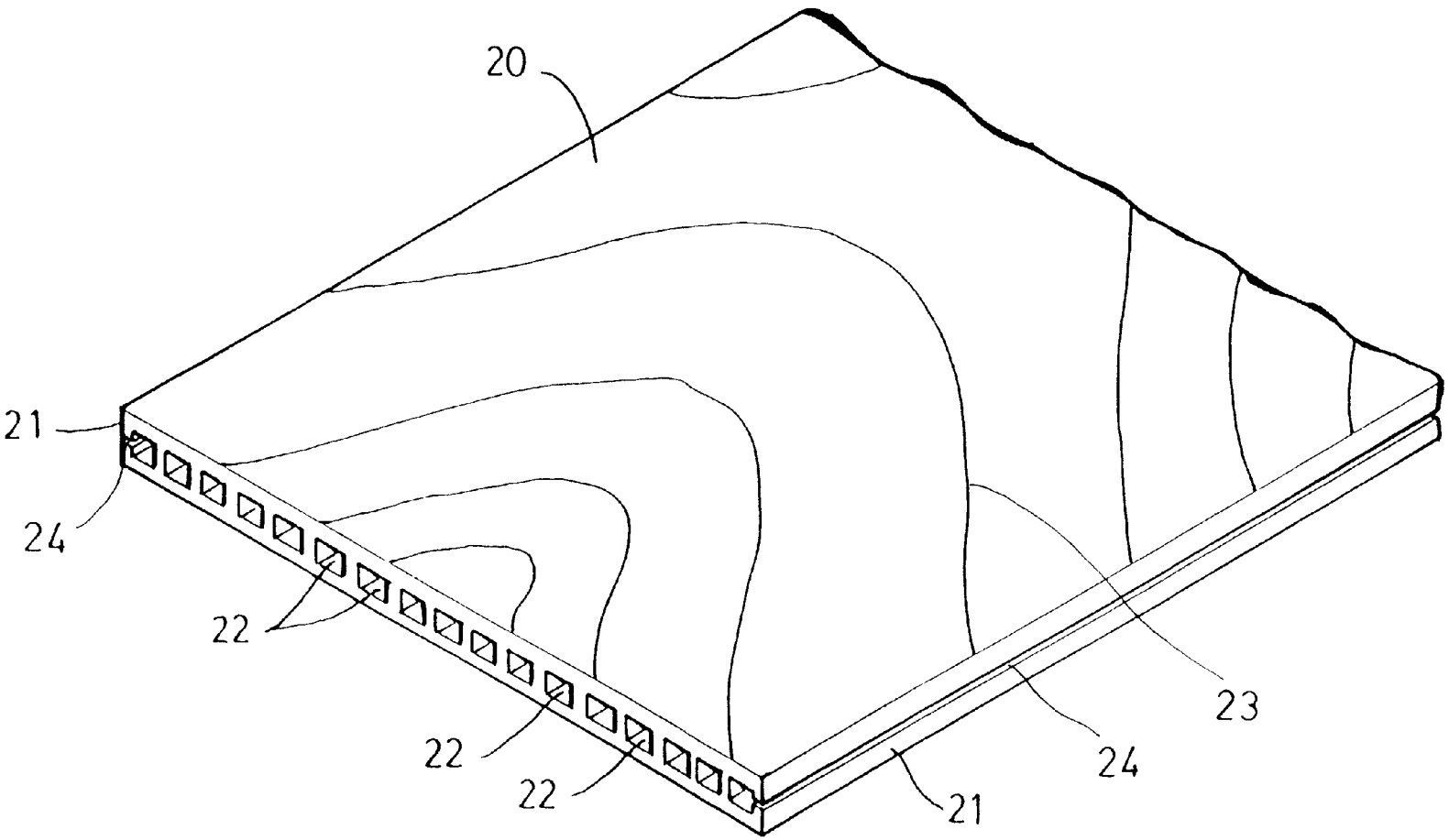
FIG. 3 is an enlarged partial perspective view showing the door panel of the sliding door assembly.

Referring to the drawings, and initially to FIGS. 1–3, a sliding door assembly in accordance with the present invention comprises two or more door panels 20 that may be formed or manufactured with molding or mold injection processes and that may be formed with various kinds of patterns 23 on the outer peripheral portion thereof, such as the wood veins pattern 23. The door panels 20 each includes one or more longitudinal grooves 22 formed therein by such as the molding or mold injection processes, for weight reducing or weight adjusting purposes, and each includes two sides each having a channel 21 longitudinally formed therein and communicating with the grooves 22 respectively and formed or defined by a pair of opposite flanges 24. The grooves 22 may be formed into various kinds of shapes, such as circular or rectangular shapes or the other shapes. The two side grooves 22 that are communicating with the side channels 21 preferably include a rectangular cross section and include a width greater than that of the channels 21 of the door panels 20.

One or more resilient couplings 30 are provided for resiliently coupling the door panels 20 together, and each includes a planer shape and each including two sides slidably engaged in the channels 21 of the door panels 20 and each having a lateral bar or stop 31 provided or extended thereon and slidably engaged in the grooves 22 of the door panels 20 and engageable with the flanges 24 of the door panels 20 for limiting the relative movement between the stops 31 and the door panels 20 and for preventing the stops 31 of the resilient couplings 30 from being disengaged from the door panels 20. The stops 31 include a width greater than that of the resilient couplings 30 and may be engaged into the grooves 22 of the door panels 20 via the upper or the lower portions of the door panels 20.

The resilient couplings 30 are made of resilient materials, such as rubber materials, for allowing the door panels 20 to be easily and freely folded relative to each other. The sliding engagement of the stops 31 of the resilient coupling 30 in the grooves 22 of the door panels 20 further allows the door panels 20 to be easily and freely folded and adjusted relative to each other.

The door panels of the sliding door assembly are made or formed primarily of foamable or spongy or composite materials which include less than 78% by weight of the door panel, and more than 20% by weight of wood chips or cut-offs or particles mixed within the foamable materials, and less than 2% by weight of the vulcanizing agent. The wood chips or wood cut-offs may be selected from the waste wood materials. The proportions of the foamable materials and of the wood materials may be adjusted or increased or decreased for adjusting the door panels to the suitable weights and for allowing the door panels to be suitably operated.

Figure 4:
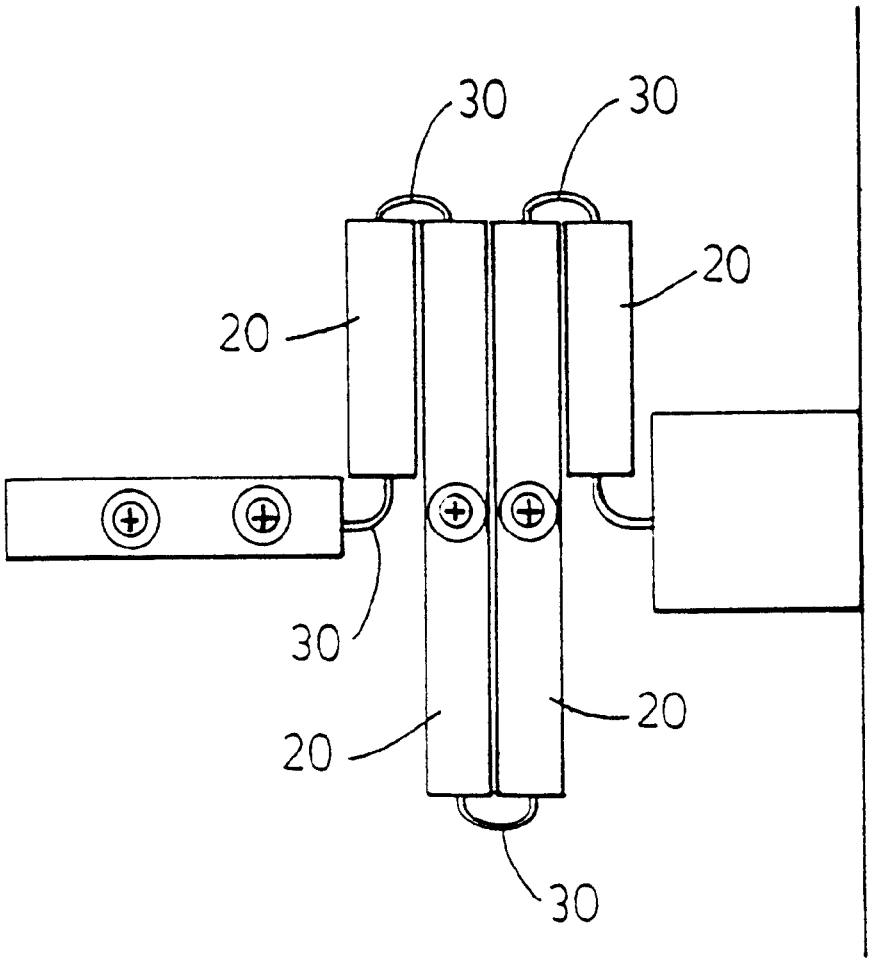
FIG. 4 is an upper view illustrating the operation of the sliding door assembly.

In operation, as shown in FIG. 4, the door panels 20 may be easily and freely rotated or folded relative to each other between the open and folded positions, in a door frame or the like. In addition, the door panels 20 may be easily and freely adjusted relative to each other, due to the sliding engagement of the stops 31 of the resilient coupling 30 in the grooves 22 of the door panels 20, such that the door assembly may be easily fitted in the door frame of various sizes or widths. Furthermore, the foamable materials and the wood materials may be adjusted to different proportions or weights for allowing the door panels to be suitably operated. In addition, the stops 31 of the resilient coupling 30 may be easily and quickly engaged into the grooves 22 of the door panels 20 for allowing the door panels 20 to be easily manufactured and assembled.

Accordingly, the sliding door assembly in accordance with the present invention includes a number of door panels coupled together with resilient couplings and formed with a material that may be mixed with the spongy or foamable materials for suitably adjusting or determining the weight of the door panels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sliding door assembly comprising:

a first door panel and a second door panel each including two sides, and each including a groove and a channel formed in each of said sides thereof respectively and communicating with each other, said groove including a width greater than that of said channel of said first and said second door panels, said first and said second door panels each including at least one second longitudinal groove formed therein for weight reducing purposes, and at least one resilient coupling including two sides slidably engaged in said channels of said first and said second door panels, and including two stops provided on said sides thereof and slidably received in said grooves of said first and said second door panels for resiliently coupling said first and said second door panels together, said first and said second door panels each including less than 78% by weight of a foamable material, and more than 20% by weight of wood chips or particles mixed within said foamable material, and less than 2% by weight of a vulcanizing agent.

* * * * *